US012578156B2

(12) United States Patent
Loveday, IV et al.

(10) Patent No.: US 12,578,156 B2
(45) Date of Patent: Mar. 17, 2026

(54) HYBRID MAGAZINE FOR A FIREARM

(71) Applicants: George E. Loveday, IV, Lenior City, TN (US); Nathan Dudney, Nashville, TN (US); Mark Hillis, Manchester, TN (US); Evan Dungan, Christiana, TN (US); Joel Stanley, Smyrna, TN (US)

(72) Inventors: George E. Loveday, IV, Lenior City, TN (US); Nathan Dudney, Nashville, TN (US); Mark Hillis, Manchester, TN (US); Evan Dungan, Christiana, TN (US); Joel Stanley, Smyrna, TN (US)

(73) Assignee: Elite Tactical Systems Group, LLC, Cheyenne, WY (US)

( * ) Notice: Subject to any disclaimer, the term of this patent is extended or adjusted under 35 U.S.C. 154(b) by 0 days.

(21) Appl. No.: 18/581,319

(22) Filed: Feb. 19, 2024

(65) Prior Publication Data

US 2025/0207879 A1 Jun. 26, 2025

Related U.S. Application Data

(60) Provisional application No. 63/446,888, filed on Feb. 19, 2023.

(51) Int. Cl.
*F41A 9/65* (2006.01)

(52) U.S. Cl.
CPC ..... *F41A 9/65* (2013.01)

(58) Field of Classification Search
None
See application file for complete search history.

(56) References Cited

U.S. PATENT DOCUMENTS 1,382,680 A * 6/1921 Searle ..... F41A 21/488 89/196
1,494,524 A * 5/1924 Adamson ..... F41A 21/00 285/391
2,387,691 A * 10/1945 Sunderland ..... F41A 17/38 89/149
3,443,334 A * 5/1969 Ardolino ..... F41A 9/70 42/50
3,577,860 A * 5/1971 Jestrabek ..... F41A 9/70 42/50
3,603,020 A * 9/1971 Wiese ..... F41A 9/69 42/88
3,732,643 A * 5/1973 Wells ..... F41A 17/38 42/50

(Continued)

*Primary Examiner* — Derrick R Morgan
(74) *Attorney, Agent, or Firm* — J. Kenneth Hoffmeister

(57) ABSTRACT

A hybrid firearm magazine. The hybrid firearm magazine has a first section fabricated from a sheet material and a second section molded from a plastic. The first section includes a mating edge defining one or more recesses. The second section engages the mating end of the first section with the plastic filling the recesses. The mating end has nonlinear edge. The plastic fills in around the nonlinear edge of the first section to form a joint. The interface of joint prevent movement of the first section relative to the second section along the vertical and horizontal axes of the hybrid firearm magazine. The thickness of the second section at the joint is substantially equal to the thickness of the first section. Optional retention couplers improve the strength of the joint and the resistance to movement of the first section relative to the second section.

20 Claims, 3 Drawing Sheets

(56) References Cited

U.S. PATENT DOCUMENTS 4,472,900 A * 9/1984 Howard ..... F41A 9/65 42/50
4,831,761 A * 5/1989 Kulakow ..... F41A 9/67 42/50
4,901,463 A * 2/1990 Chesnut ..... F41A 9/65 42/50
5,113,605 A * 5/1992 Kim ..... F41A 9/71 42/50
5,279,059 A * 1/1994 Howard ..... F41A 9/63 42/50
5,584,136 A * 12/1996 Boland ..... F41A 9/71 42/50
6,739,082 B2 * 5/2004 Christensen ..... F41A 9/70 42/49.02
7,513,537 B2 * 4/2009 Mosing ..... F16L 37/2445 285/401
8,006,423 B1 * 8/2011 Alzamora ..... F41A 9/65 42/50
8,028,455 B1 * 10/2011 Battaglia ..... F41A 9/71 42/49.02
8,225,541 B2 * 7/2012 Bigley ..... F41A 9/70 42/49.01
8,607,489 B1 * 12/2013 Calvert ..... F41A 9/71 42/49.02
8,850,732 B2 * 10/2014 Zheng ..... F41A 9/70 42/49.02
8,887,428 B1 * 11/2014 Lemoine ..... F41A 9/63 42/49.02
8,966,801 B1 * 3/2015 Bentley ..... F41B 11/55 42/50
D738,454 S * 9/2015 Smith ..... D22/108
9,239,197 B1 * 1/2016 Christensen ..... F41A 9/65
9,328,982 B2 * 5/2016 Ladner ..... F41A 9/71
10,066,886 B2 * 9/2018 Vilardi ..... F41A 9/69
10,527,374 B1 * 1/2020 August ..... F41A 9/66
10,809,027 B2 * 10/2020 Michut ..... F41A 9/70
11,073,353 B2 * 7/2021 Hendricks ..... F41A 21/487
11,662,165 B1 * 5/2023 Viani ..... F41A 9/65 42/50
12,203,719 B1 * 1/2025 Hart ..... F41A 9/70
12,203,720 B2 * 1/2025 Zusman ..... B29C 45/14311
2010/0154271 A1 * 6/2010 Victor ..... F41A 17/063 42/70.07
2010/0154275 A1 * 6/2010 Faifer ..... F41C 23/16 29/592
2010/0281737 A1 * 11/2010 Cahill ..... F41A 9/70 42/50
2012/0233899 A1 * 9/2012 Daniel ..... F41A 9/65 42/49.01
2013/0086834 A1 * 4/2013 Battaglia ..... F41A 9/65 42/49.02
2014/0075810 A1 * 3/2014 Mikroulis ..... F41A 17/36 42/50
2015/0316340 A1 * 11/2015 Ladner ..... F41A 9/71 42/49.02
2016/0209140 A1 * 7/2016 Toth ..... F41A 9/65
2016/0320155 A1 * 11/2016 Singh ..... F41A 17/72
2018/0031342 A1 * 2/2018 Faifer ..... F41A 9/71
2018/0347929 A1 * 12/2018 Hsu ..... F41A 9/71
2021/0080204 A1 * 3/2021 Yeates ..... B29C 45/14336
2021/0215446 A1 * 7/2021 Czarnecki ..... G05B 15/02
2022/0136789 A1 * 5/2022 Lee ..... F41A 9/62 42/49.01
2023/0235981 A1 * 7/2023 Williams ..... F41A 9/71 42/49.01
2024/0219134 A1 * 7/2024 Zusman ..... F41A 9/70
2024/0344793 A1 * 10/2024 Royce ..... F41A 9/70
2024/0369316 A1 * 11/2024 Vitulli ..... F41A 9/70

* cited by examiner

HYBRID MAGAZINE FOR A FIREARM

BACKGROUND

Conventional firearm magazines are fabricated from metal, plastic, or a combination of the two. Plastic magazines have certain advantages over metal magazines that make them highly desirable. For example, plastic magazines are often cheaper to manufacture, lighter, quieter, and exhibit better chemical resistance characteristics. Additionally, plastics offer features not available with metals, such as allowing a see-through magazine. Further, molded plastic magazines can have more complex shapes than a stamped metal magazine.

Despite this, metal magazines typically maintain one critical advantage. Metal magazines have greater strength and rigidity compared to plastic magazines of the same wall thickness. In general, metal magazines have greater durability when dropped. The feed lips of a metal magazine are less likely to bend or fracture. Moreover, a metal magazine typically exhibits less swelling when loaded, e.g., at the taper of a double stack magazine, compared to plastics at a given wall thickness.

The basic design of a firearm magazine is constrained by the size of the magazine well of the associated firearm and the size of the rounds to be held by the magazine. The external and internal dimensions imposed by the magazine well and the rounds dictate the wall thickness. Firearms with magazines originally designed using metal may have magazine wall thickness so thin that they preclude the use of plastic magazines. In other cases, plastic magazine alternatives are available but may be significantly less reliable than the metal magazines they replace.

Not surprisingly, hybrid magazines are an attempt to merge the best features of metal and plastics and mitigate the deficiencies. Using metal to bolster the strength of the magazine at high stress points in an otherwise plastic magazine is undoubtedly desirable. Conventional hybrid magazines typically use over and/or under molding to join the plastic and metal. While such techniques may be suitable for magazines designed for certain firearms, the dimensional limitations and tolerances make hybrid magazine design a challenge and, in certain cases, impossible.

It is with respect to these and other considerations that the present invention has been made.

SUMMARY OF THE INVENTION

The following summary discusses various aspects of the invention described more fully in the detailed description and claimed herein. It is not intended to be limiting and should not be used to limit the claimed invention to only such aspects or to require the invention to include all such aspects.

The hybrid magazine includes a body having a first section and a second section. The hybrid magazine has one or more walls. The thickness of the walls in the hybrid magazine is dictated by the dimensions of the magazine well of the corresponding firearm and the dimensions of the cartridges for which the hybrid magazine is designed. The top end of the first section defines an opening bounded by the feed lips. A taper region narrows the first section and transitions the cartridges from a double stack configuration of the second section to single stack configuration for presentation at the feed lips. The first section and the second section are dissimilar materials. A conventional hybrid magazine utilizes a plastic over or under molded onto a metal component. Further, a conventional hybrid magazine may include through openings or blind openings in the metal component that are filled with the plastic for alignment, to further maintain the connection between of the plastic, or both.

For purposes of discussion, the first section is the upper part of the magazine that includes the taper region and the feed lips. The taper region and the feed lips experience the most stress. The first section is fabricated from a metal. The second section is the lower section of the magazine and is fabricated from a plastic. This hybrid approach allows the magazine to obtain the best of both materials. The first section provides the necessary strength and rigidity in the areas where it is need most while the second section offers enhancements such as weight reduction, translucency for visualization of rounds in the magazine, complex geometries for improved grip or other purposes, and ease of manufacturing.

The hybrid magazine includes retention features that securely join the first section and the second section and prevent movement along the vertical axis, the lateral (left-right) axis, and the longitudinal (front-back) axis. The retention features include the alignment joint where the second section is molded to the first section. The hybrid magazine optionally includes at least one retention coupler that prevent separation of the first section and the second section vertically and horizontally.

The retention coupler includes one or more projections (i.e., tabs) or recesses (i.e., slots) formed by the first section and complementary components formed by the second section. The tabs are molded during the formation of the second section and fill the slots of the first section. The retention coupler has two functions. First, the retention coupler increases the surface of the contact region the upper section and the lower section. Second, the geometry of the retention coupler enhances the resistance to movement of the first section relative to the second section along one or more of the vertical axis, the lateral axis, or the longitudinal axis.

The slots and tabs of the retention coupler have two main structural features the serve to maintain the connection between the first section and the second section. First, the slot has depth h relative to edge of the first section. The depth h of the slot creates an impediment to movement of the first section relative to the second section in the horizontal direction. Second, the slot has variable width w over the depth h to create some portion of the slot that is wider than the rest of the slot. This overhang creates an impediment to movement of the first section relative to the second section in the direction of the horizontal axis running parallel to the wall containing the retention coupler. Because the portion of the retention coupler formed by the second section is molded, there are no complicated manufacturing processes or fitment issues such as would be encountered if trying to join sections made from pre-formed rigid materials.

The shape of retention coupler increases the surface area connected by the alignment joint and, therefore, strengthen the bond between the first section and the second section. The face of the edge of the first section is not flat where it connects to the second section. The first section has a nonlinear edge. When the second section is molded to the first section, the plastic fills in the area of the nonlinear edge of the first section edge to form the alignment joint. The height of the alignment joint is typically only a small fraction of the overall wall thickness such that the combined thickness at the alignment joint is substantially equal to the thicknesses of the first section and the second section proximate to the alignment joint. The alignment joint prevents movement of the first section relative to the second section in the direction of the axis running perpendicular to the face of the wall.

One aspect of the present invention is that the faces of the first section and the second section are substantially planar. Thus, the there is no significant change in thickness of the wall between the first section and the second section at the alignment joint. It is contemplated that there may some situations where the design of the firearm or the magazine allows for non-critical dimensional differences at other places. Dimensional variations in the wall thickness occurring in such non-critical portions of the magazine are not considered be part of the retention features or other aspects of the present invention and are considered to fall within the scope and spirit of the present invention.

BRIEF DESCRIPTION OF THE DRAWINGS

Further features, aspects, and advantages of the present disclosure will become better understood by reference to the following figures wherein like reference numbers indicate like elements throughout the several views.

DETAILED DESCRIPTION

Aspects of a hybrid firearm magazine are described herein and illustrated in the accompanying figures. The hybrid firearm magazine has a first section fabricated from a sheet material and a second section molded from a plastic. The first section includes a mating edge defining one or more recesses. The second section engages the mating end of the first section with the plastic filling the recesses. The mating end has nonlinear edge. The plastic fills in around the nonlinear edge of the first section to form a joint. The interface of joint prevent movement of the first section relative to the second section along the vertical and horizontal axes of the hybrid firearm magazine. The thickness of the second section at the joint is substantially equal to the thickness of the first section. Optional retention couplers improve the strength of the joint and the resistance to movement of the first section relative to the second section.

For convenience, generic references to the materials used in the construction of the hybrid magazine may be used. Such references are not intended to be limiting. Specifically, references to "plastic" are intended to encompass to any moldable material having a polymeric base including thermoset plastics, thermoplastics, and plastic composites (e.g., a glass filled nylon). Further, references to "metal" are intended to encompass any substantially rigid sheet material suitable for use in a magazine having greater strength/less ductility than plastics. By way of example, Table 1 lists some of the relevant physical properties of a representative metal and a representative plastic used in conventional magazines.

TABLE 1

Relevant Physical Properties of Representative Materials

| Material | 1020 Cold Rolled Steel | Radel ® R PPSU |
|---|---|---|
| Compressive Strength | 172 MPa (25,000 psi) | 98.9 MPa (14,344 psi) |
| Tensile Strength, Yield | 350 MPa (50,763 psi) | 69.6 MPa (10,095 psi) |
| Shear Strength | 287 MPa (41,626 psi) | 62.7 MPa (9,094 psi) |

Figure 1:
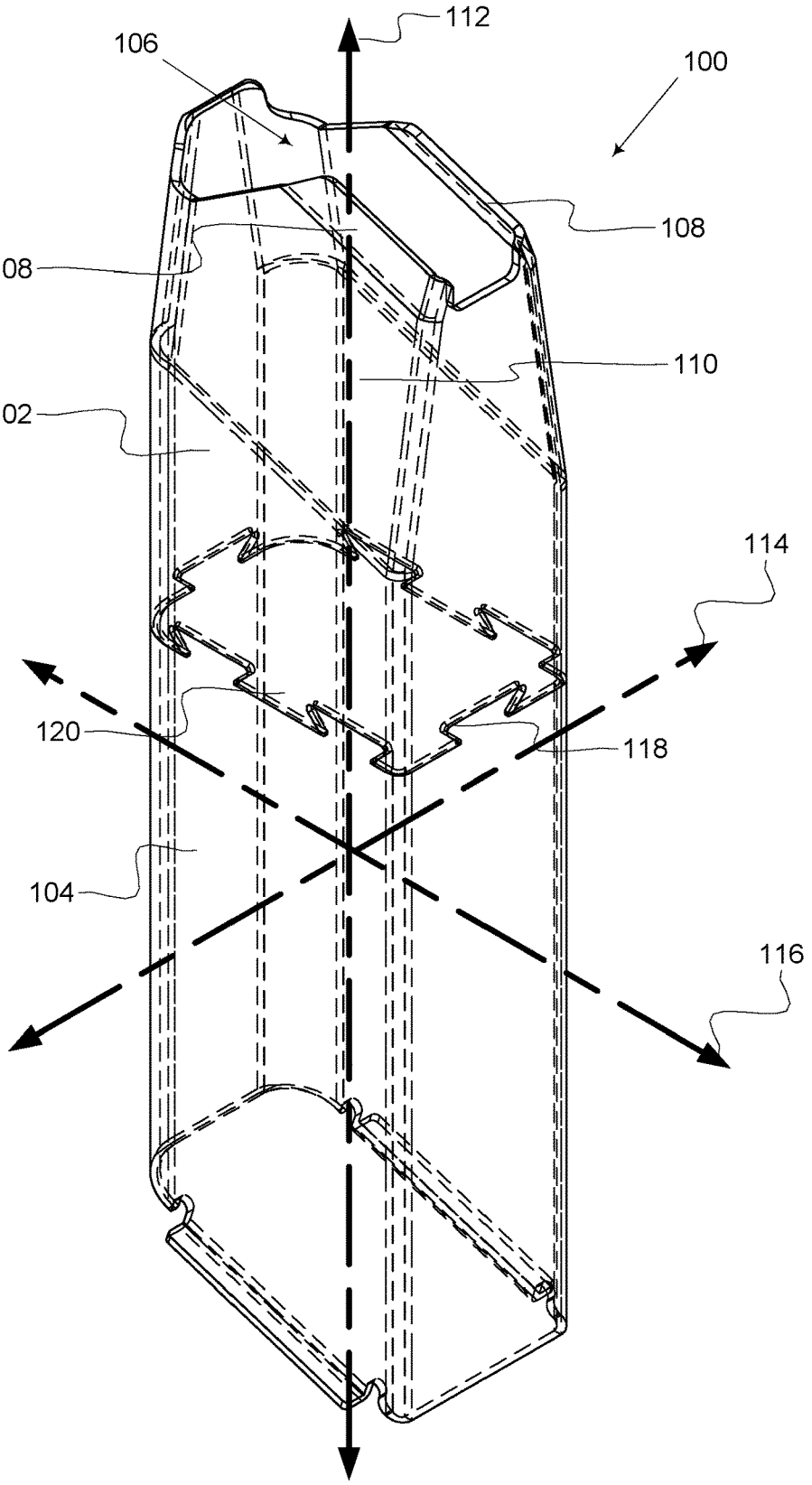
FIG. 1 is a rear perspective view with transparency of an embodiment of a hybrid firearm magazine illustrating aspects of the present invention.

FIG. 1 is a rear perspective view with transparency of an embodiment of a hybrid firearm magazine illustrating aspects of the present invention. The hybrid magazine 100 includes a body having a first section 102 and a second section 104. Those skilled in the art will recognize that a complete hybrid magazine 100 includes other components not illustrated in FIG. 1, such as a spring, a follower, and a floor plate. One skilled in the art understands that the floor plate attaches to the body and covers a bottom opening of the magazine. The follower is positioned inside the body and the spring is positioned between the floor plate and the follower.

The hybrid magazine has one or more walls. The thickness of the walls in the hybrid magazine is dictated by the dimensions of the magazine well of the corresponding firearm and the dimensions of the cartridges for which the hybrid magazine 100 is designed. The top end of the first section 102 defines an opening 106 bounded by the feed lips 108. A taper region 110 narrows the first section 102 and transitions the cartridges from a double stack configuration of the second section 104 to single stack configuration for presentation at the feed lips 108. In the exemplary embodiments, the hybrid magazine 100 is depicted as a double-stack box magazine having a substantially tubular housing. However, the present invention is applicable to other types, shapes, and designs of firearm magazines.

Aspects of the present invention contemplate that the first section 102 and the second section 104 are dissimilar materials. A conventional hybrid magazine utilizes a plastic over or under molded onto a metal component. Further, a conventional hybrid magazine may include through openings or blind openings in the metal component that are filled with the plastic for alignment, to further maintain the connection between of the plastic, or both. Often a combination of these techniques in the construction of a conventional hybrid magazine. Over and under molding necessarily increases the wall thickness and can only be used in magazines where the dimensions allow for a greater wall thickness. However, there are certain magazines, e.g., magazines for the SIG P365®, where over or under molding is not an option because of tight tolerances. Aspects of the present invention allow for the fabrication of a hybrid magazine where tight tolerances preclude the use of conventional hybrid magazine construction techniques.

In the illustrated embodiment, the first section 102 is the upper part of the magazine 100 that includes the taper region 110 and the feed lips 108. As previously mentioned, the taper region 110 and the feed lips 108 experience the most stress. The first section 102 is fabricated from a metal. The second section 104 is the lower section of the magazine 100 and is fabricated from a plastic. This hybrid approach allows the magazine to obtain the best of both materials. The first section 102 provides the necessary strength and rigidity in the areas where it is need most while the second section offers enhancements such as weight reduction, translucency for visualization of rounds in the magazine, complex geometries for improved grip or other purposes, and ease of manufacturing.

The hybrid magazine 100 includes retention features that securely join the first section 102 and the second section 104 and prevent movement along the vertical axis 112, the lateral (left-right) axis 114, and the longitudinal (front-back) axis 116. Herein, the lateral axis 114 and the longitudinal axis 116 may be referred to as the horizontal axes where reference to a particular direction is not needed. The retention features include the alignment joint 118 where the second section 104 is molded to the mating end of the first section 102. The hybrid magazine 100 optionally includes at least one retention coupler 120 that prevent separation of the first section 102 and the second section 104 vertically and horizontally.

The retention coupler 120 includes one or more projections (i.e., tabs) or recesses (i.e., slots) formed by the first section 102 and complementary components formed by the second section 104. For purposes of discussion, the portion of the retention coupler 120 formed by the first section 102 will be referred to as slots and the portion of the retention coupler 120 formed by the second section 104 will be referred to as tabs. The tabs are molded during the formation of the second section 104 and fill the slots of the first section 102. Regardless of the nomenclature, the retention coupler 120 has two functions. First, the retention coupler 120 increases the surface of the contact region the upper section 102 and the lower section 104. Second, the geometry of the retention coupler 120 enhances the resistance to movement of the first section 102 relative to the second section 104 along one or more of the vertical axis 112, the lateral axis 114, or the longitudinal axis 116. In embodiment of FIG. 1, the transparent illustration shows retention couplers 120 arranged around the entire perimeter of the magazine 100 along the alignment joint 118.

Because of the design of the alignment joint 118 and the optional retention coupler 120, overmolding is not required to join the second section 104 to the first section 102. Thus, the dimensions of the hybrid magazine 100 can remain consistent with a conventional all metal magazine and obtain the benefits of utilizing a plastic for portions of the hybrid magazine 100. This allows fabrication of hybrid magazines for firearms where the tight fitment tolerances imposed by the dimensions of the magazine well and the size of the rounds preclude the use of plastic magazines and the use of hybrid magazines made using conventional techniques, such as overmolding. For example, plastics cannot provide the required strength in magazine walls limited to a certain thickness while overmolding a plastic onto a metal wall causes the magazine to exceed the dimensional requirements placed on the magazine by the firearm.

Figure 2:
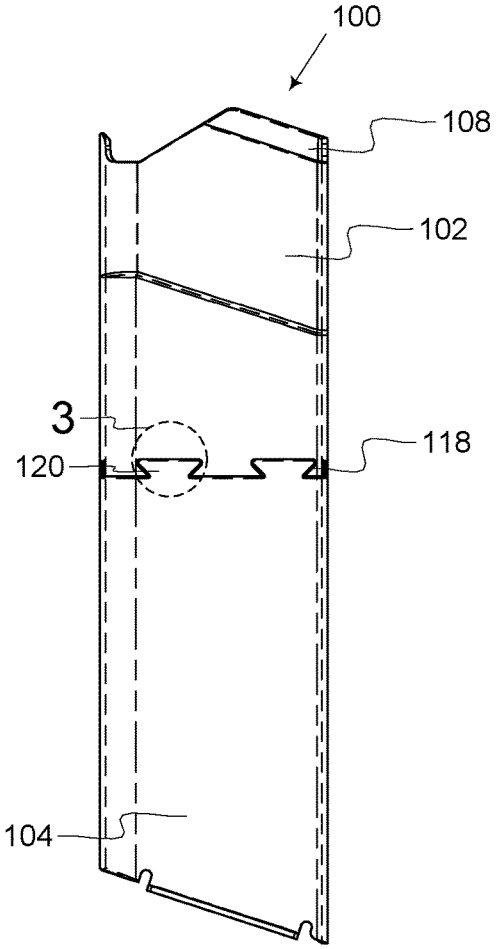
FIG. 2 is a side elevation view with transparency of an embodiment of a hybrid magazine incorporating aspects of the present invention illustrating aspects of the present invention.

FIG. 2 is a side elevation view with transparency of an embodiment of a hybrid magazine incorporating aspects of the present invention. Focusing on the retention couplers 120, the first section 102 and the second section 104 each define both slots and tabs. Alternate embodiments fabricate the tabs as part of the first section and the slots are formed around the tabs when the lower section is molded.

Figure 3:
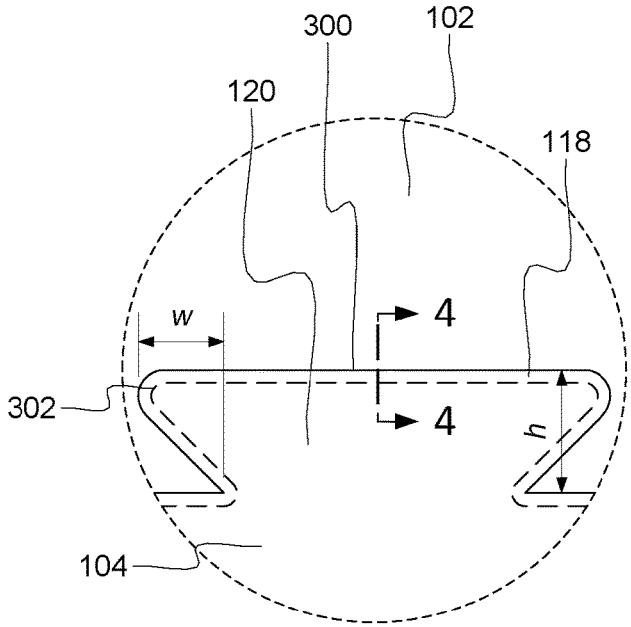
FIG. 3 is an illustration with transparency of the retention coupler in greater detail taken from inset 3 of FIG. 2.

FIG. 3 is an illustration with transparency of the retention coupler in greater detail taken from inset 3 of FIG. 2. In the illustrated embodiment, the retention coupler 120 is a generally trapezoidal molded projection of the second section 104 that fills a generally trapezoidal recess 300 defined by the first section 102. As will be discussed in reference to FIG. 4, the end of the first section 102 is tapered to create an interface with the second section. A dashed line represents the terminal edge 302 of the first section 102. It should be noted that the alignment joint 118 continues around the perimeter of the retention coupler 120. The area between the between the terminal edge 302 and the start of the recess 300 is the alignment joint 118 where the second section 104 laps and bonds to the first section 102.

The slots and tabs of the retention coupler 120 have two main structural features the serve to maintain the connection between the first section 102 and the second section 104. First, the slot has depth h relative to edge of the first section 102. The depth h of the slot creates an impediment to movement of the first section 102 relative to the second section 104 in the horizontal direction. Second, the slot has variable width w over the depth h to create some portion of the slot that is wider than the rest of the slot. This overhang creates an impediment to movement of the first section 102 relative to the second section 104 in the direction of the horizontal axis running parallel to the wall containing the retention coupler 120. In the embodiment of FIGS. 1-3, the retention couplers 120 have a generally trapezoidal shape. However, a wide variety of shapes with the desired structural features are available for use to accomplish the purpose of the retention coupler. Because the portion of the retention coupler 120 formed by the second section 104 is molded, there are no complicated manufacturing processes or fitment issues such as would be encountered if trying to join sections made from pre-formed rigid materials.

The shape of retention coupler 120 increases the surface area connected by the alignment joint 118 and, therefore, strengthen the bond between the first section 102 and the second section 104. It should be noted that in embodiments of the hybrid magazine 100 utilizing multiple retention couplers 120 arranged around the perimeter, the distribution of the load over multiple retention couplers 120 further strengthens the effectiveness of the retention features.

Figure 4:
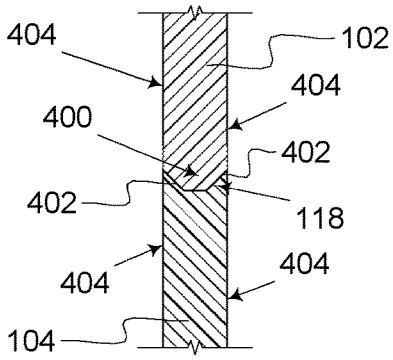
FIG. 4 is a section view taken along line 4-4 of FIG. 3 showing aspects of the alignment joint in greater detail.

FIG. 4 is a section view taken along line 4-4 of FIG. 3 showing aspects of the alignment joint in greater detail. The face of the edge 400 of the first section 102 is not flat where it connects to the second section 104. In the illustrated embodiment, the first section 400 has a nonlinear edge 402. In various embodiments, the nonlinear edge 402 is a convex edge treatment such as a radius cut, a bevel, a chamfer, and other similar softening of the edges (i.e., a contour). Aspects of the present invention allow for different edge treatments to be used at different points for aesthetic or practical reasons. For example, a chamfer may be applied along substantially straight edge portions while a radius cut may be used along curved edge portions for ease of manufacturing. While a convex edge treatment is generally easier to manufacture and is illustrated herein, a concave edge treatment would accomplish the same purpose and falls within the scope and spirit of the present invention.

When the second section 104 is molded to the first section 102, the plastic fills in the area of the nonlinear edge 402 of the first section edge 400 to form the alignment joint 118. The height of the alignment joint 118 is typically only a small fraction of the overall wall thickness such that the combined thickness at the alignment joint 118 is substantially equal to the thicknesses of the first section 102 and the second section 104 proximate to the alignment joint 118. Effectively, the interface is akin to intentionally controlled flashing created during the molding process; however, with a suitably strong plastic, this small interface creates a structure that is sufficient to minimize or eliminate the likelihood that the wall of the second section 104 becomes misaligned from the wall of the first section 102. In other words, the alignment joint prevents movement of the first section 102 relative to the second section 104 in the direction of the axis running perpendicular to the face of the wall.

Beyond preventing misalignment of the walls, the alignment joint 118 also contributes to preventing movement of the first section 102 relative to the second section 104. During the molding process, the plastic bonds with the metal of the first section 102 and creates resistance to separation in the direction of the vertical axis 112. As the plastic cools, it shrinks and creates an even tighter compression fitting with the first section 102 that prevents the relative movement of the first section 102 and the second section 104 relative to the horizontal axes. Because the alignment joint 118 extends around the entire perimeter of the magazine, the lateral runs provide resistance against the relative movement of the first section 102 and the second section 104 in direction of the longitudinal axis 116 and the longitudinal runs provide resistance against the relative movement of the first section 102 and the second section 104 in direction of the lateral axis 114.

One aspect of the present invention is that the faces 404 of the first section 102 and the second section 104 are substantially planar. Thus, the there is no significant change in thickness of the wall between the first section 102 and the second section 104 at the alignment joint 118. It is contemplated that there may some situations where the design of the firearm or the magazine allows for non-critical dimensional differences at other places. For example, in an extended magazine there are no dimensional limitations imposed by the firearm on the portion of the magazine that sticks out beyond the magazine well. Dimensional variations in the wall thickness occurring in such non-critical portions of the magazine are not considered be part of the retention features or other aspects of the present invention and are considered to fall within the scope and spirit of the present invention.

Figure 5:
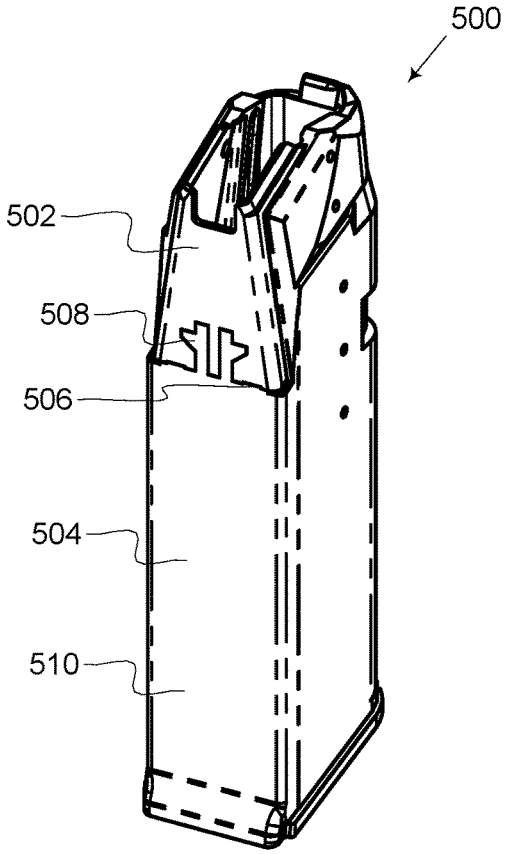
FIG. 5 is a rear perspective view of an alternate embodiment of a hybrid magazine according to the present invention.

FIG. 5 is a rear perspective view of an alternate embodiment of a hybrid magazine incorporating aspects of the present invention. In the embodiment of FIG. 5, the hybrid magazine 500 is designed for use with a firearm that has greater tolerances for the fitment of the magazine into the magazine well. The hybrid magazine includes a first section 502 and a second section 504. The first section 502 is constructed of a metal or other suitable sheet material. The second section 504 is constructed of a plastic or other suitable moldable material.

As before, the hybrid magazine 500 includes retention features that securely join the first section 502 and the second section 504. The retention features include an alignment joint 506 where the second section 504 is molded to the first section 502. The hybrid magazine 500 optionally includes one or more retention couplers 508 that facilitate the connection between the first section 502 and the second section 504 on at least one wall of the hybrid magazine 500 where the thickness of that magazine wall remains substantially equal in the area around the joint between the first section 502 and the second section 504. Again, dimensional variations in the wall thickness occurring in such non-critical portions of the magazine are not considered be part of the retention features or other aspects of the present invention and are considered to fall within the scope and spirit of the present invention. The embodiment of the retention coupler 508 shown in FIG. 5 represents a more complex shape and reiterates that various shapes can be used without departing from the scope and spirit of the present invention.

In some magazines, at least portions of some walls of a magazine have relaxed dimensional limitations. For example, consider a magazine for a magazine well located in a pistol grip. Based on the size of the cartridges, there dimensional limitations from front to rear may be more cumbersome than from side to side. As such, there may not sufficient clearance to employ overmolding, undermolding, throughmolding, or other conventional molding techniques on either or both of the front and rear walls but plenty of room for such conventional molding techniques on the side walls. Even if sufficient clearance exists to use such conventional molding techniques on, for example, the front wall, there remains a need for a way to securely join the first section 502 to the second section 504 of the rear wall 510. The embodiment of FIG. 5 illustrates this particular configuration, but the concepts described herein apply to any wall or set of walls of the magazine.

In FIG. 5, the joint 506 and the retention couplers 508 are used on the rear wall 510 of the hybrid magazine 500. While aspects of the joint 506 or the retention couplers 508 may be incorporated into the side walls and front wall of the hybrid magazine 500, the side walls and front wall benefit from the ability to utilize conventional molding techniques. Thus, the first section 502 may include through openings that help secure overmolded or undermolded components of the second section 504 to the first section 502.

It is not sufficient to merely secure the first section 502 to the second section 504 on three sides of the hybrid magazine 500. The walls of a magazine generally present a smooth linear face along their length. Even a small offset in a wall between the first section 502 and the second section 504 can cause rounds to catch in the magazine or prevent clean insertion and removal of the magazine from the magazine well. Thus, the alignment joint facilitates maintaining a smooth linear face for the magazine wall.

Figure 6:
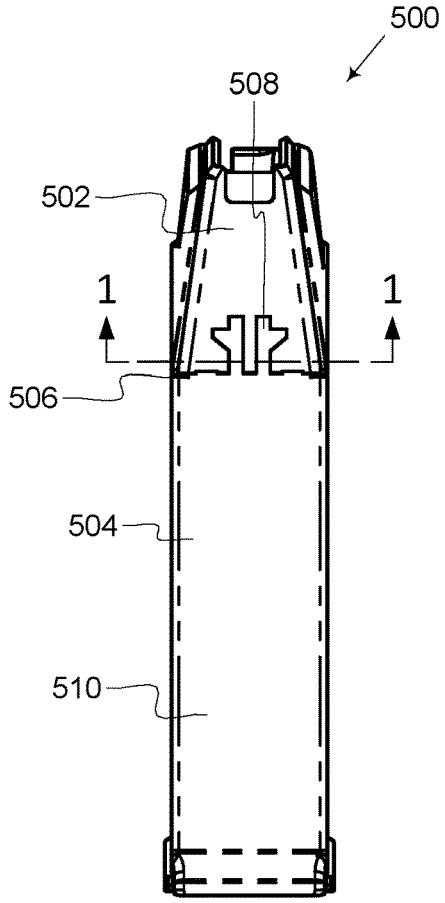
FIG. 6 is a rear elevation view of an alternate embodiment of a hybrid magazine incorporating aspects of the present invention.

FIG. 6 is a rear elevation view of an alternate embodiment of a hybrid magazine incorporating aspects of the present invention.

Figure 7:
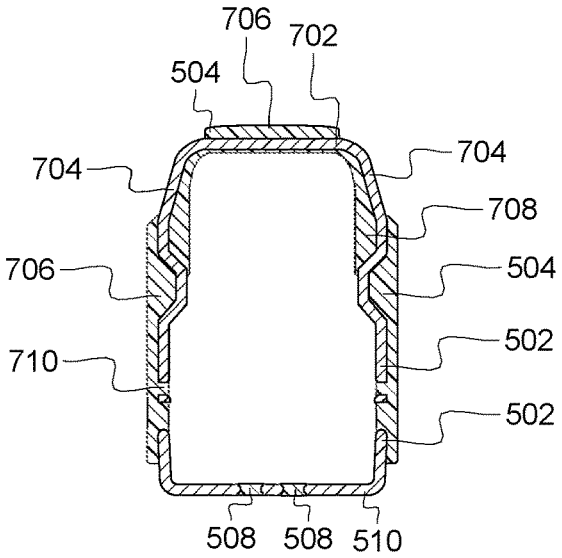
FIG. 7 is a section view taken along line 7-7 of FIG. 6 showing aspects of the present invention.

FIG. 7 is a section view taken along line 7-7 of FIG. 6 showing aspects of the present invention. The front wall 702 and the side walls 704 of the first section 502 are at least partially bounded by overmolding 706 and undermolding 708 forming part of the second section 504. The side walls 704 of the first section 502 define through openings 710 that are filled with plastic forming part of the second section 504. While shown and described as through openings, blind openings could also be used.

In accordance with aspects of the present invention, the rear wall 510 of the first section 502 does not have any overmolding, undermolding or throughmolding. The joint 506 and the optional retention couplers 508 include the nonlinear edge treatment described herein with reference to FIG. 4 are the sole structures joining the rear wall 510 of the first section 502 and the second section 504. Thus, in the exemplary case of the dimensionally limited rear wall 510, the retention features maintain the rear wall alignment between the first section 502 and the second section 504.

The above specification, examples, and data provide a complete description of the manufacture and use of the composition of the invention. Since many implementations of the invention can be made without departing from the spirit and scope of the invention, the invention resides in the claims hereinafter appended.

What is claimed is:

1. A hybrid firearm magazine fabricated from two dissimilar materials, said firearm magazine defining a vertical axis and two horizontal axes, said horizontal axes including a lateral axis and a longitudinal axis, said hybrid firearm magazine comprising:

a first section having a plurality of walls forming a tubular structure having a first mating end, said first section having an inner face and an outer face, said first mating end having an inner portion proximate to said inner face, an outer portion proximate to said outer face, and a central portion between said inner portion and said outer portion, said inner portion and said outer portion tapering toward said central portion to define a nonlinear edge, said plurality of walls having a first thickness, said first section fabricated from a metal; and a second section having a plurality of walls forming a tubular structure having a second mating end, said second section fabricated from a plastic, said plastic filling in around said nonlinear edge to form a joint, said joint limiting misalignment of the corresponding walls of said first section plurality of walls and said second section plurality of walls, said joint having a surface area and a second thickness, said second thickness being substantially equal to said first thickness.

2. The hybrid firearm magazine of claim 1 further comprising a retention coupler preventing movement of said second section relative to said first section in the direction of the vertical axis.

3. The hybrid firearm magazine of claim 2 wherein said retention coupler further comprises:

a retention slot defined by said first mating end; and a retention tab formed by said second mating end, said retention tab filling in around said retention tab during fabrication of said second section.

4. The hybrid firearm magazine of claim 1 wherein said nonlinear edge defines a contour selected from the group consisting of a chamfer, a bevel, and a radius.

5. The hybrid firearm magazine of claim 1 wherein said second section has a third thickness, said third thickness being substantially equal to said first thickness proximate to said joint.

6. A hybrid firearm magazine, said hybrid firearm magazine comprising:

a first section fabricated from a first material, said first section being substantially tubular, said first section having an inner face and an outer face and a first thickness therebetween, said first section having a mating end, said mating end having an edge, said mating end having a surface area and a contour between said inner face and said outer face such that said first mating end tapers to said edge; and a second section being substantially tubular, said second section fabricated from a second material, said second material being a moldable material and different from said first material, said second material complementarily filling in around said contour to secure said second section to said first section and maintaining alignment of the walls of said first section and said second section, said second section having a second thickness where said second material fills in around said contour, said second thickness being substantially equal to said first thickness.

7. The hybrid firearm magazine of claim 6 wherein said mating end defines a recess, said recess increasing said mating end edge surface area, said second material complementarily filling in said recess to form a projection.

8. The hybrid firearm magazine of claim 7 wherein said recess is narrowest proximate to said second section.

9. The hybrid firearm magazine of claim 6 wherein said mating end defines a projection, said projection increasing said mating end surface area, said second material complementarily filling in said projection.

10. The hybrid firearm magazine of claim 9 wherein said projection is widest proximate to said second section.

11. The hybrid firearm magazine of claim 7 wherein said recess and said projection cooperate to prevent vertical movement and movement in at least one horizontal direction of said second section relative to said first section.

12. The hybrid firearm magazine of claim 6 wherein said first section edge and said lower section edge cooperate to prevent horizontal movement of said upper section relative to said lower section.

13. The hybrid firearm magazine of claim 6 wherein said first section edge and said second section edge cooperate to keep corresponding walls of said first section and said second section in alignment to maintain a substantially planar inner face defined by said corresponding walls.

14. The hybrid firearm magazine of claim 6 wherein said first material is a metal and said second material is a plastic.

15. The hybrid firearm magazine of claim 14 wherein plastic is a material having a polymeric base selected from the group consisting of thermoset plastics, thermoplastics, and plastic composites.

16. The hybrid firearm magazine of claim 6 wherein said contour is selected from the group consisting of a chamfer, a bevel, and a radius.

17. A hybrid firearm magazine, said hybrid firearm magazine comprising:

an upper section having a plurality of side walls, said upper section being substantially tubular and having a top end and a bottom end, said top end having a set of feed lips and defining an upper opening between said set of feed lips, said upper section bottom end having an edge, said edge having a contoured cross-section, said upper section plurality of side walls having a first thickness proximate to said bottom end, said contoured cross-section being across the thickness and having two side portions and a middle portion, said middle portion having a different height relative to said side portions, at least one of said plurality of side walls defining a first at least one coupler part at said bottom end, said at least one coupler part selected from the group consisting of a slot and a tab, said upper section fabricated from a metal;

a lower section having a plurality of side walls, said lower section being substantially tubular and having a top end and a bottom end, said lower section top end having an edge, said lower section top end edge being complementary to said upper section bottom end edge, said lower section forming at least one complementary coupler part for each said first at least one coupler part, said lower section plurality of side walls having a second thickness proximate to said top end, said second thickness being substantially equal to said first thickness, said lower section top edge, said lower section fabricated from a plastic.

18. The hybrid firearm magazine of claim 17 wherein the height of said side portions varies as said side portions taper towards the middle portion.

19. The hybrid firearm magazine of claim 17 wherein said upper section bottom end edge and said lower section top end edge cooperate to prevent horizontal movement of said upper section relative to said lower section.

20. The hybrid firearm magazine of claim 17 wherein said upper section bottom end edge and said lower section top end edge cooperate to keep corresponding walls of said upper section plurality of side walls and said lower section plurality of side walls in alignment to maintain a substantially planar inner face defined by said corresponding walls.

* * * * *